US009010220B2

(12) United States Patent
Chen

(10) Patent No.: US 9,010,220 B2
(45) Date of Patent: Apr. 21, 2015

(54) PASS-THRU RATCHET WRENCH

(71) Applicant: Chia-Yu Chen, Taichung (TW)

(72) Inventor: Chia-Yu Chen, Taichung (TW)

( * ) Notice: Subject to any disclaimer, the term of this patent is extended or adjusted under 35 U.S.C. 154(b) by 0 days.

(21) Appl. No.: 14/288,967

(22) Filed: May 28, 2014

(65) Prior Publication Data

US 2015/0075332 A1 Mar. 19, 2015

(30) Foreign Application Priority Data

Sep. 13, 2013 (TW) ..... 102217259 U

(51) Int. Cl.
*B25B 13/46* (2006.01)
*B25B 13/04* (2006.01)
*B25B 15/04* (2006.01)

(52) U.S. Cl.
CPC ..... *B25B 13/461* (2013.01); *B25B 13/04* (2013.01); *B25B 13/463* (2013.01); *B25B 15/04* (2013.01); *B25B 13/467* (2013.01)

(58) Field of Classification Search
CPC .. B25B 13/463; B25B 13/461; B25B 13/467; B25B 15/04
USPC ..... 81/60–62, 63.2
See application file for complete search history.

(56) References Cited

U.S. PATENT DOCUMENTS

| | | | | | |
|---|---|---|---|---|---|
| 4,991,468 | A * | 2/1991 | Lee | 81/60 |
| 6,044,731 | A * | 4/2000 | Hsieh | 81/63.2 |
| 6,148,695 | A * | 11/2000 | Hu | 81/60 |
| 6,151,993 | A * | 11/2000 | Shiao | 81/60 |
| 6,305,247 | B1 * | 10/2001 | Chen | 81/60 |
| 6,435,063 | B1 * | 8/2002 | Chen | 81/63.2 |
| 6,488,136 | B2 * | 12/2002 | Chang | 192/46 |
| 6,651,533 | B1 * | 11/2003 | Hsien | 81/60 |
| 6,857,339 | B2 * | 2/2005 | Chen | 81/63.1 |
| 7,017,453 | B2 * | 3/2006 | Hu | 81/63.2 |
| 7,082,861 | B1 * | 8/2006 | Chen | 81/63.2 |
| 7,178,429 | B2 * | 2/2007 | Lin | 81/60 |
| 7,263,919 | B2 * | 9/2007 | Arnold | 81/63.2 |

* cited by examiner

*Primary Examiner* — Monica Carter
*Assistant Examiner* — Danny Hong
(74) *Attorney, Agent, or Firm* — Ming Chow; Sinorica, LLC

(57) ABSTRACT

A pass-thru ratchet wrench includes a wrench body. A front end of the wrench body has a head portion. A ratchet is provided in the head portion. The ratchet has a receiving hole to receive a socket. The ratchet has a first neck portion at an upper edge thereof and an annular groove around the outer wall of the first neck portion. The annular groove has a certain depth. The ratchet has a plurality of through holes in annular groove. A C-shaped buckle ring is disposed in the annular groove. The C-shaped buckle ring extends out of the through holes to form a limit portion. The limit portion is adapted to stop the socket, thereby the receiving hole of the ratchet can limit the socket from displacing.

3 Claims, 7 Drawing Sheets

PASS-THRU RATCHET WRENCH

The current application claims a foreign priority to the patent application of Taiwan No. 102217259 filed on Sep. 13, 2013.

BACKGROUND OF THE INVENTION

1. Field of the Invention

The present invention relates to a pass-thru ratchet wrench.

2. Description of the Prior Art

These days, a wrench is an essential hand tool. At a mechanical factory, a motor repair shop, and the like, various wrenches are always used for work, such as ring spanners, socket wrenches, open-ended wrenches, adjustable wrenches, and ratchet wrenches, used to disassemble bolts so as to facilitate maintenance or assembly. Wherein, a one-way successive brake ratchet wrench combines the features of a hex wrench and a ratchet wrench, which not only enhances the work efficiency and product quality greatly but also brings quite convenience.

FIG. 1 is an exploded view of a conventional pass-thru ratchet wrench and a socket. The conventional pass-thru ratchet wrench 200 comprises a wrench body 201. The wrench body 201 has a head portion 202. A one-way ratchet 203 is provided in the head portion 202. The ratchet 203 has a receiving hole 204 therein. The receiving hole 204 is a dodecagonal through hole adapted to receive a socket 300. Thereby, the user can disassemble a bolt smoothly for maintenance or assembly.

The wrench body 201 of the aforesaid pass-thru ratchet wrench 200 uses the receiving hole 204 to connect the socket 300. When the user uses the wrench body 201 to connect the socket 300 and turn the socket 300 simultaneously, the socket 300 in the receiving hole 204 may cause a displacement or disengagement, so the user cannot apply a force smoothly to turn the socket 300. Therefore, the receiving hole 204 of the wrench body 201 is to fit on the socket 300 again in order to turn the socket 300. During use, the conventional pass-thru ratchet wrench 200 is inconvenient for use and influences the smoothness of work.

An improved pass-thru ratchet wrench is developed to improve the shortcomings of the aforesaid pass-thru ratchet wrench 200. FIG. 2 is an exploded view of the conventional pass-thru ratchet wrench and another socket. The socket 300 has a connecting head portion 301. The outer wall of the connecting head portion 301 is formed with an annular groove 302. An elastic buckle ring 303 is provided and accommodated in the annular groove 302. Thus, when the connecting head portion 301 is coupled to the receiving hole 204 of the head portion 202, the elastic buckle ring 303 will elastically hold against the inner wall of the receiving hole 204 to provide an engaging and positioning effect. This ensures that the socket 300 won't disengage from the pass-thru ratchet wrench 200 during operation.

Due to the improved structure of the socket 300 of the pass-thru ratchet wrench 200, there will be a plurality of sockets 300 of different specifications. Therefore, each socket 300 must be provided with the elastic buckle ring 303, which increases a lot of production cost and time. For the elastic buckle ring 303 to hold against the inner wall of the receiving hole 204, the elastic buckle ring 303 must be in a polygonal shape and slightly protrude out of the annular groove 302. It is difficult to process and produce the elastic buckle ring 303. Besides, the shape of the elastic buckle ring 303 is not easy to maintain, so the elasticity of the elastic buckle ring 303 cannot be controlled with ease. When the sockets 300 of different specifications are coupled to the pass-thru ratchet wretch 200, some sockets 200 coupled to the receiving hole 204 are too tight and some sockets 200 coupled to the receiving hole 204 are too loose.

Accordingly, the inventor of the present invention has devoted himself based on his many years of practical experiences to solve these problems.

SUMMARY OF THE INVENTION

The primary object of the present invention is to provide a pass-thru ratchet wrench which can be manufactured easily to lower the cost and can prevent the socket in the receiving hole from a linear displacement or disengagement.

In order to achieve the aforesaid object, the pass-thru ratchet wrench of the present invention comprises a wrench body. The front end of the wrench body is formed with a head portion. The head portion has an accommodation trough therein. Another side of the head portion is formed with a first through hole communicating with the accommodation trough. A ratchet is disposed in the accommodation trough. The ratchet has a first neck portion at an upper edge thereof and a second neck portion at a lower edge thereof. The first neck portion is inserted in the first through hole for the ratchet to be fitted and limited in the accommodation trough. The ratchet has an axial polygonal receiving hole. The ratchet has an annular groove around the outer wall of the first neck portion. The annular groove has a certain depth. The junction of every two adjacent connecting surfaces of the receiving hole is formed with a through hole. A C-shaped buckle ring is disposed in the annular groove of the ratchet. The C-shaped buckle ring extends out of the through holes to form a limit portion. A rear lid is provided to cover the bottom end surface of the accommodation trough. The rear lid has a second through hole. Through the second through hole, the rear lid is fitted on the second neck portion of the ratchet.

When the user wants to connect a socket to the receiving hole, the limit portion will elastically stop the socket so that the socket is secured in the receiving hole to ensure that the socket in the receiving hole of the ratchet won't cause a linear displacement when the user operates the pass-thru ratchet wrench. Thereby, there is no need for each socket to be provided with an elastic buckle ring. The pass-thru ratchet wrench of the present invention is applicable to different sockets. The pass-thru ratchet wrench of the present invention can be manufactured easily to lower the cost and can prevent the socket in the receiving hole from a linear displacement or disengagement to improve the drawbacks of the conventional pass-thru ratchet wrench.

DETAILED DESCRIPTION OF THE PREFERRED EMBODIMENTS

Embodiments of the present invention will now be described, by way of example only, with reference to the accompanying drawings.

Figure 1:
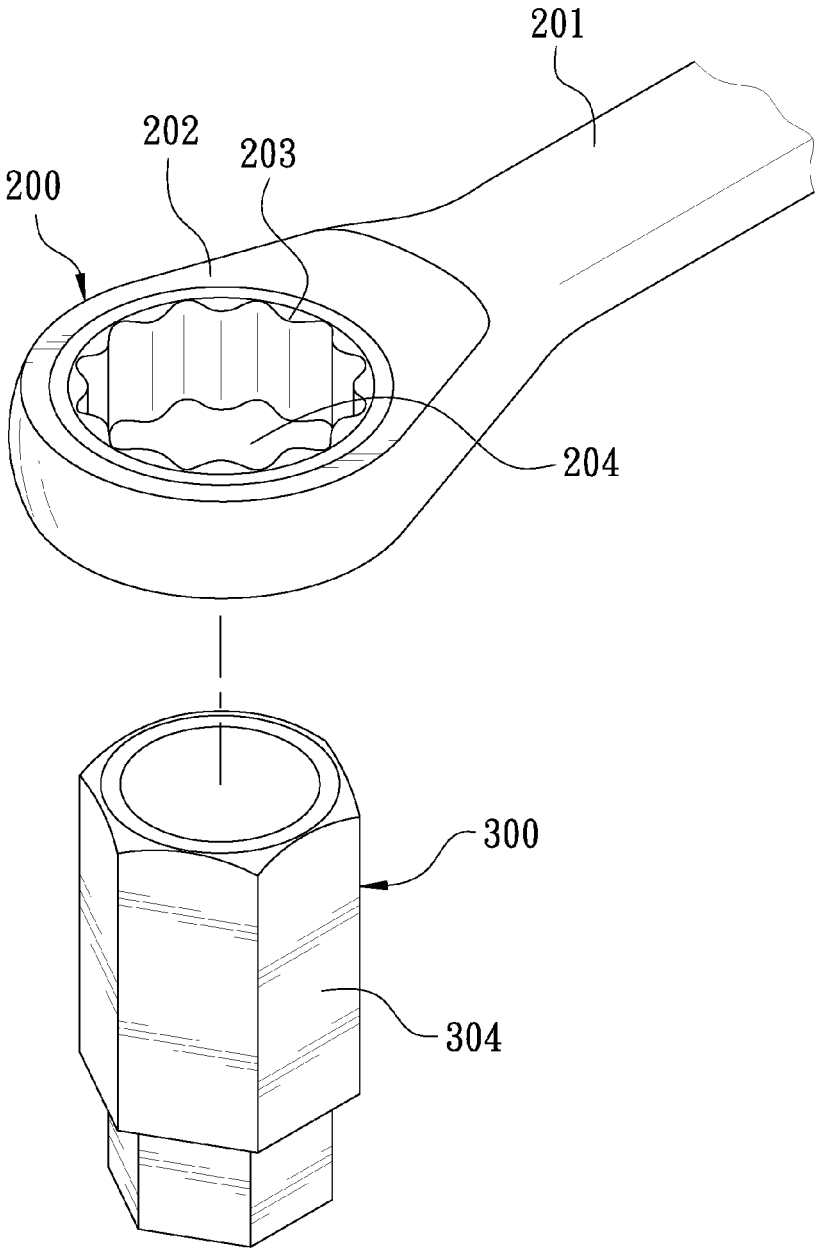
FIG. 1 PRIOR ART
FIG. 1 is an exploded view of a conventional pass-thru ratchet wrench and a socket.
Figure 2:
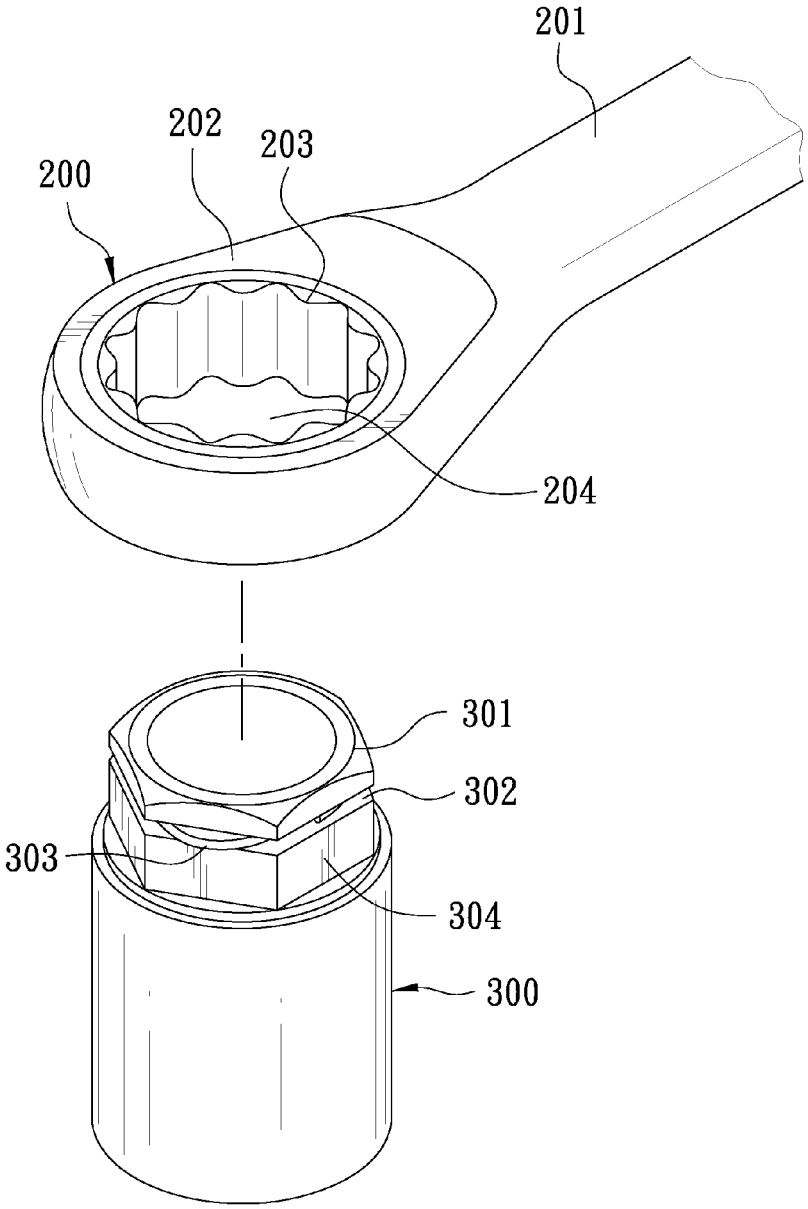
FIG. 2 PRIOR ART
FIG. 2 is an exploded view of the conventional pass-thru ratchet wrench and another socket.
Figure 3:
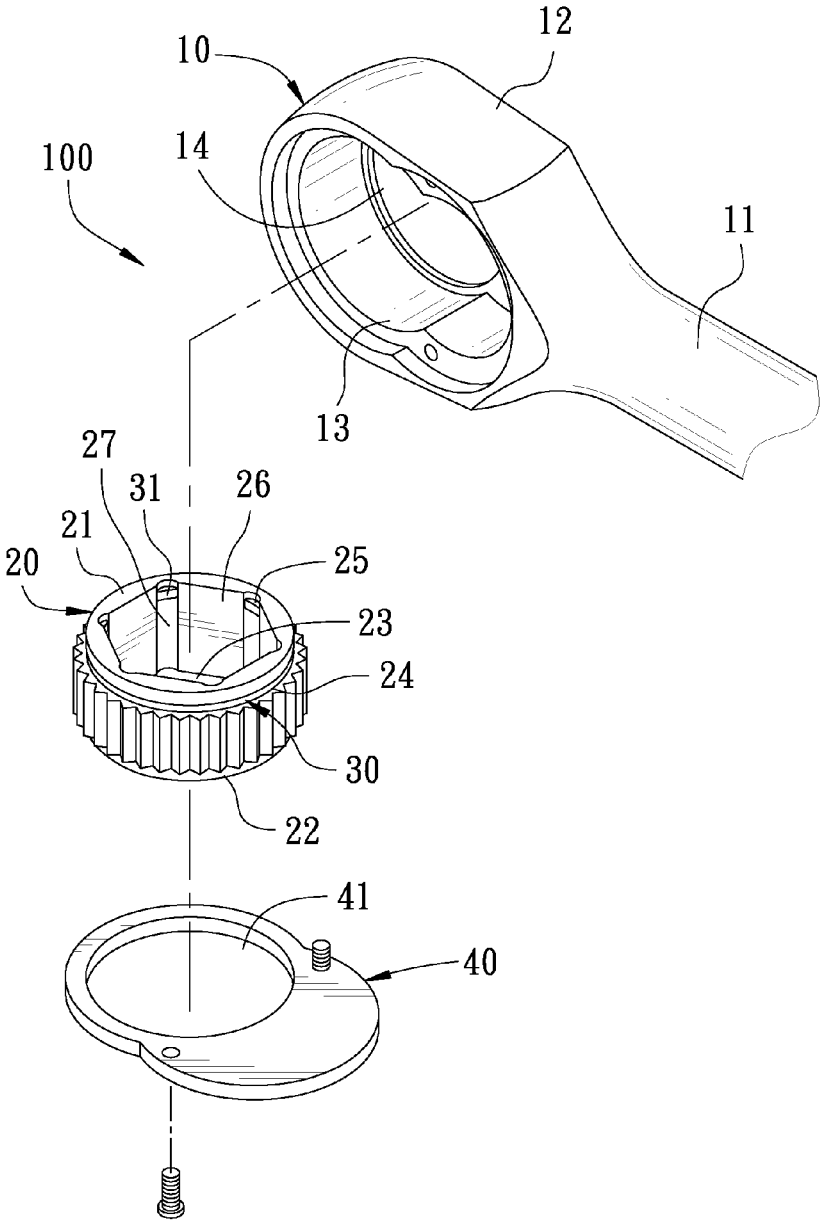
FIG. 3 is an exploded view according to a preferred embodiment of the present invention.
Figure 4:
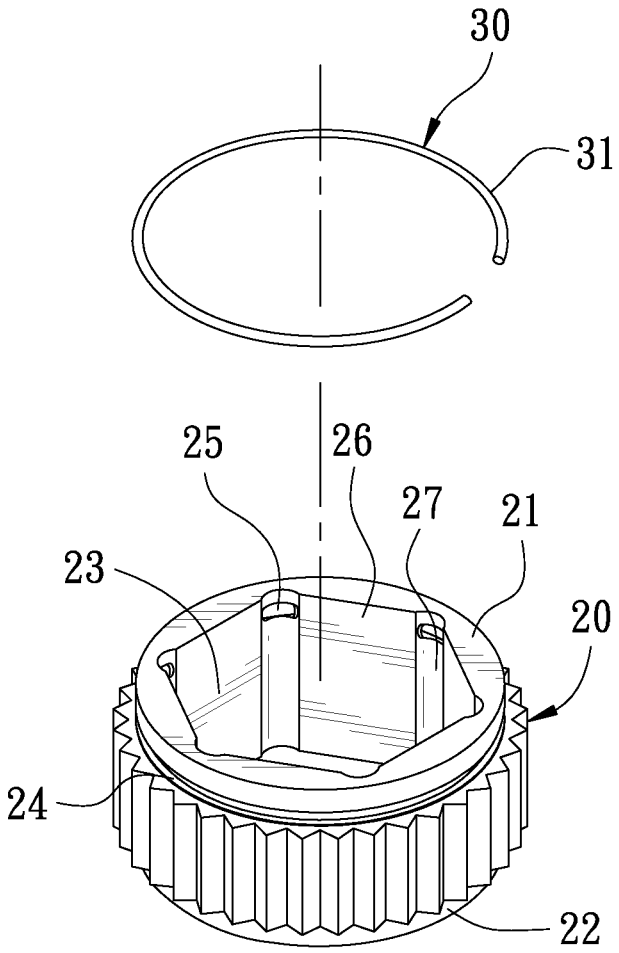
FIG. 4 is a partial exploded view according to the preferred embodiment of the present invention.
Figure 5:
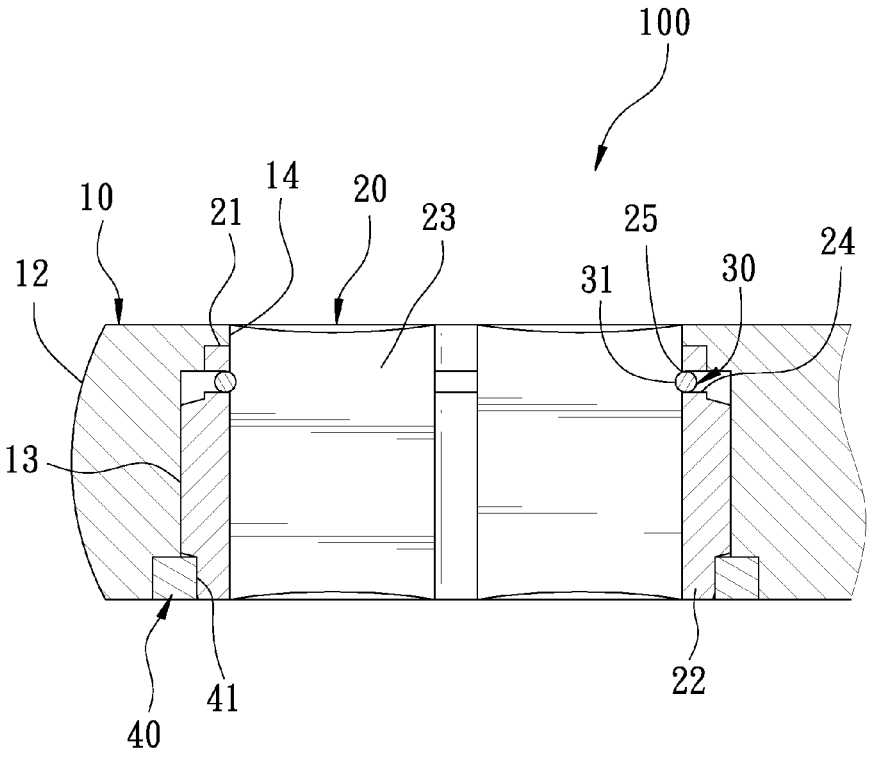
FIG. 5 is a partial enlarged sectional view according to the preferred embodiment of the present invention.

The present invention discloses a pass-thru ratchet wrench. FIG. 3 is an exploded view according to a preferred embodiment of the present invention. FIG. 4 is a partial exploded view according to the preferred embodiment of the present invention. FIG. 5 is a partial enlarged sectional view according to the preferred embodiment of the present invention. The pass-thru ratchet wrench 100 comprises a wrench body 10, a ratchet 20, a C-shaped buckle ring 30, and a rear lid 40.

The wrench body 10 has a handle 11. The front end of the handle 11 is formed with a head portion 12. The head portion 12 has an accommodation trough 13 therein and a first through hole 14 communicating with the accommodation trough 13.

The ratchet 20 is disposed in the accommodation trough 13. The ratchet 20 has a first neck portion 21 at an upper edge thereof and a second neck portion 22 at a lower edge thereof. The first neck portion 21 is inserted in the first through hole 14 for the ratchet 20 to be fitted and limited in the accommodation trough 13. The ratchet 20 has an axial polygonal receiving hole 23. The inner wall of the receiving hole 23 has a plurality of connecting surfaces 26. The junction of every two adjacent connecting surfaces 26 is formed with an axial concave surface 27. The ratchet 20 has an annular groove 24 around the outer wall of the first neck portion 21. The annular groove 24 has a certain depth. The junction of every two adjacent connecting surfaces 26 of the receiving hole 23 is formed with a through hole 25. All the through holes 25 of the connecting surfaces 26 are disposed at the same height.

The C-shaped buckle ring 30 is disposed in the annular groove 24 of the ratchet 20. The C-shaped buckle ring 30 extends out of the through holes 25 to form a plurality of limit portions 31.

The rear lid 40 is adapted to cover the bottom end surface of the accommodation trough 13 of the wrench body 10. The rear lid 40 has a second through hole 41. Through the second through hole 41, the rear lid 40 is fitted on the second neck portion 22 of the ratchet 20.

Figure 6:
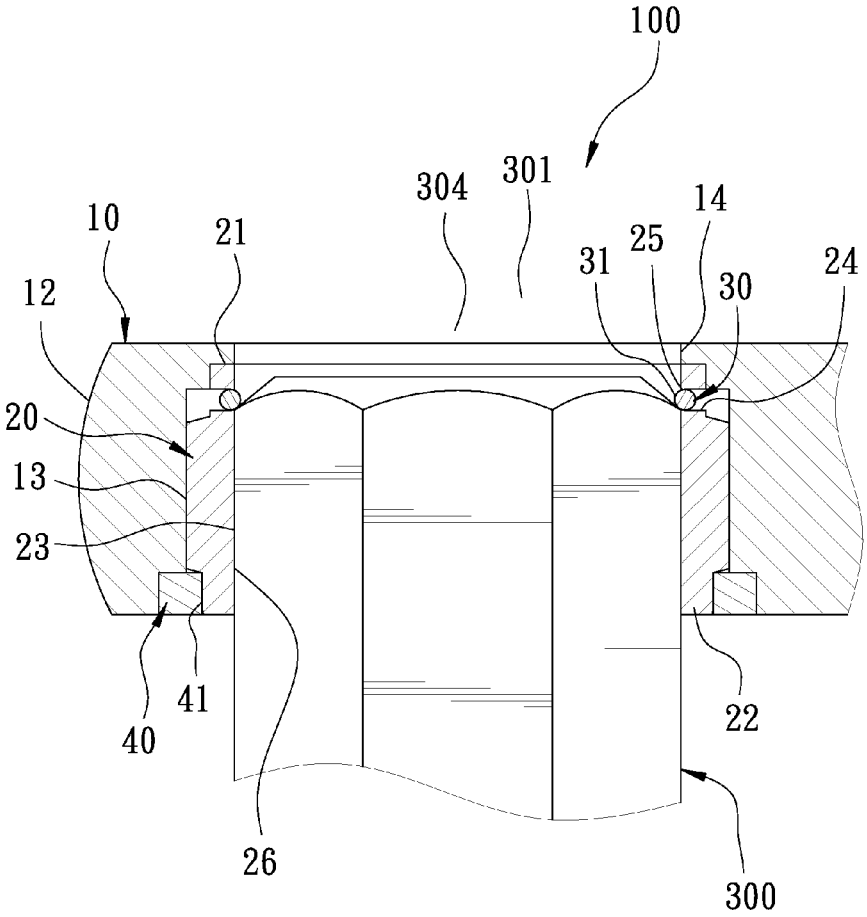
FIG. 6 is a schematic view of the preferred embodiment of the present invention when in use.

FIG. 6 is a schematic view of the preferred embodiment of the present invention when in use. When the user wants to connect the socket 300 to the wrench body 10, the annular groove 24 of the ratchet 20 engages with the C-shaped buckle ring 30. The C-shaped buckle ring 30 extends out of the through holes 25 of the annular groove 24 to form the limit portions 31. The limit portions 31 slightly extend out of the inner wall of the receiving hole 23. Therefore, when the socket 300 is connected in the receiving hole 23 of the ratchet 20, the limit portions 31 formed by the C-shaped buckle ring 30 will elastically stop the socket 300 so that the socket 300 is secured in the receiving hole 23 of the ratchet 20 to ensure that the socket 300 in the receiving hole 23 of the ratchet 20 won't cause a linear displacement when the user operates the pass-thru ratchet wrench 100. The C-shaped buckle ring 30 can be produced easily to lower the manufacture cost effectively.

Figure 7:
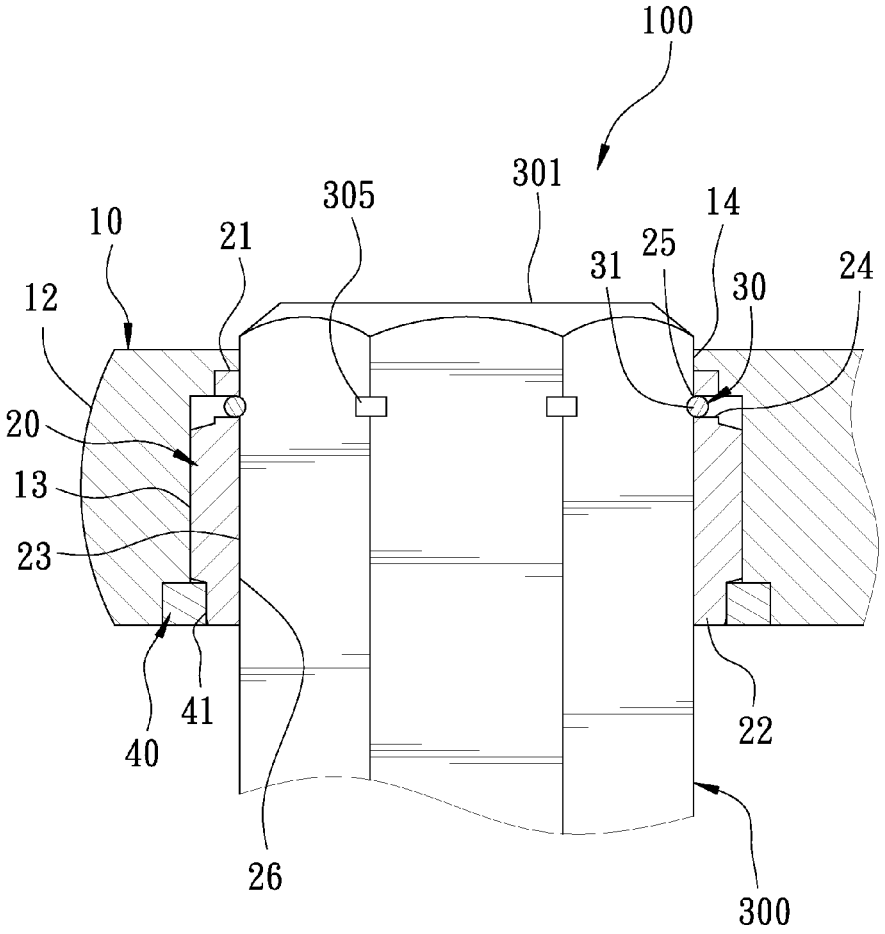
FIG. 7 is a schematic view of another embodiment of the present invention when in use.

FIG. 7 is a schematic view of another embodiment of the present invention when in use. In this embodiment, the socket 300 can be secured in the receiving hole 23 more stably. The outer wall of the socket 300 has a plurality of engaging surfaces 304. An engaging recess 305 is formed at the junction of two adjacent engaging surfaces 304. All the engaging recesses 305 of the engaging surfaces 304 are located at the same height. The receiving hole 23 is provided with the limit portions 31. When the socket 300 is connected in the receiving hole 23, the limit portions 31 in the receiving hole 23 engage with the engaging recesses 305 of the socket 300 so that the socket 300 is secured at the position where the limit portions 31 are engaged. Through the limit portions 31 in the receiving hole 23 to engage with the engaging recesses 305 of the socket 300, the socket 300 can be secured in the receiving hole 23 of the pass-thru ratchet wrench 100 stably. The engaging recess is formed the junction of two adjacent engaging surfaces, rendering the production cost to be lowered effectively.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pass-thru ratchet wrench having a wrench body, a front end of the wrench body being formed with a head portion, the head portion having a through accommodation trough therein, the accommodation trough being adapted to receive a ratchet in an axial direction, the ratchet having a polygonal receiving hole therein, an inner wall of the receiving hole having a plurality of connecting surfaces, the receiving hole being adapted to receive a socket, characterized by:

the ratchet having a first neck portion at an upper edge thereof and an annular groove around an outer wall of the first neck portion, the junction of every two adjacent connecting surfaces of the receiving hole being formed with a through hole;

a C-shaped buckle ring disposed in the annular groove of the ratchet, wherein when the C-shaped buckle ring is buckled in the annular groove, the C-shaped buckle ring is exposed and extends out of the through holes of the adjacent connecting surfaces of the receiving hole to form a plurality of limit portions.

2. The pass-thru ratchet wrench as claimed in claim 1, wherein an outer wall of the socket has a plurality of engaging surfaces, the junction of every two adjacent engaging surfaces being formed with an engaging recess for the limit portions to be engaged therein.

3. The pass-thru ratchet wrench as claimed in claim 1, wherein the junction of every two adjacent connecting surfaces of the receiving hole is formed with an axial concave surface.

* * * * *